United States Patent [19]

Nikaido

[11] Patent Number: 5,040,951

[45] Date of Patent: Aug. 20, 1991

[54] OIL PUMP

[75] Inventor: Masaya Nikaido, Saitama, Japan

[73] Assignee: Jidosha Kiki Co., Ltd., Tokyo, Japan

[21] Appl. No.: 445,383

[22] Filed: Dec. 4, 1989

[30] Foreign Application Priority Data

Dec. 26, 1988 [JP] Japan ..... 63-328566

[51] Int. Cl.[5] ..... F04B 21/02; F04B 23/06

[52] U.S. Cl. ..... 417/310; 417/286; 417/287

[58] Field of Search ..... 417/286, 287, 310, 428, 417/288

[56] References Cited

U.S. PATENT DOCUMENTS

| | | | |
|---|---|---|---|
| 2,280,392 | 4/1942 | Herman et al. | 417/287 |
| 2,700,397 | 1/1955 | Compton | 417/286 |
| 4,412,789 | 11/1983 | Ohe et al. | 417/288 |

FOREIGN PATENT DOCUMENTS 62-200185 12/1987 Japan .

OTHER PUBLICATIONS

H. L. Stewart, Practical Guide to Fluid Power; Jun. 1968; p. 430.

*Primary Examiner*—Leonard E. Smith
*Assistant Examiner*—Laleh Jalali
*Attorney, Agent, or Firm*—Flynn, Thiel, Boutell & Tanis

[57] ABSTRACT

An oil pump includes a pair of pump cartridges, one of which can be unloaded. Oil which is discharged from one of the pump cartridges is supplied to an accumulator through a supply passage in which an orifice is provided. The orifice is opened and closed in response to a pressure which prevails in the accumulator. A spool is operated upon by a pressure differential across the orifice to return the discharged oil to the suction side of the pump. A clearance is formed between the outer surface of the spool and the inner surface of the valve opening in which the spool is fitted, permitting the oil in a chamber into which a pressure prevailing downstream of the orifice is introduced to be returned to the return path.

3 Claims, 4 Drawing Sheets

OIL PUMP

BACKGROUND OF THE INVENTION

The invention relates to an oil pump for use on a vehicle or the like, and in particular, to an oil pump which is provided with an unload valve.

Recently, an oil pump which is intended to be used in a power steering apparatus of a vehicle is increasingly finding its application as a source of pressure for other hydraulic instruments. Generally, a duplex pump is used for a combination of power steering apparatus and another instrument. In this instance, a total pump capacity increases, which in turn increases a load on the pump as compared with the prior art practice, causing an increase in the input power and a reduction in the output from the vehicle. Another disadvantage relates to an increased heating effect. To accommodate for this, there is provided an unload valve which unloads one pump section of the duplex pump which is used for purpose other than driving the power steering apparatus under a given condition.

However, in a conventional oil pump which is provided with an unload valve, the pump and the unload valve are separate from each other, or must be connected together through a piping with consequences that the reliability is degraded as a result of an increased number of interconnections and an oil leakage, that a larger space is required for the assembly and that an increased cost results from an increased number of assembling steps. Additionally, vibration and noise problems arise as a result of a surge pressure which is developed within a lower pressure piping during an unload phase.

SUMMARY OF THE INVENTION

Therefore, it is an object of the invention to provide an oil pump which achieves a power saving, and which is compact and exhibits a high reliability.

DESCRIPTION OF EMBODIMENT

Figure 1:
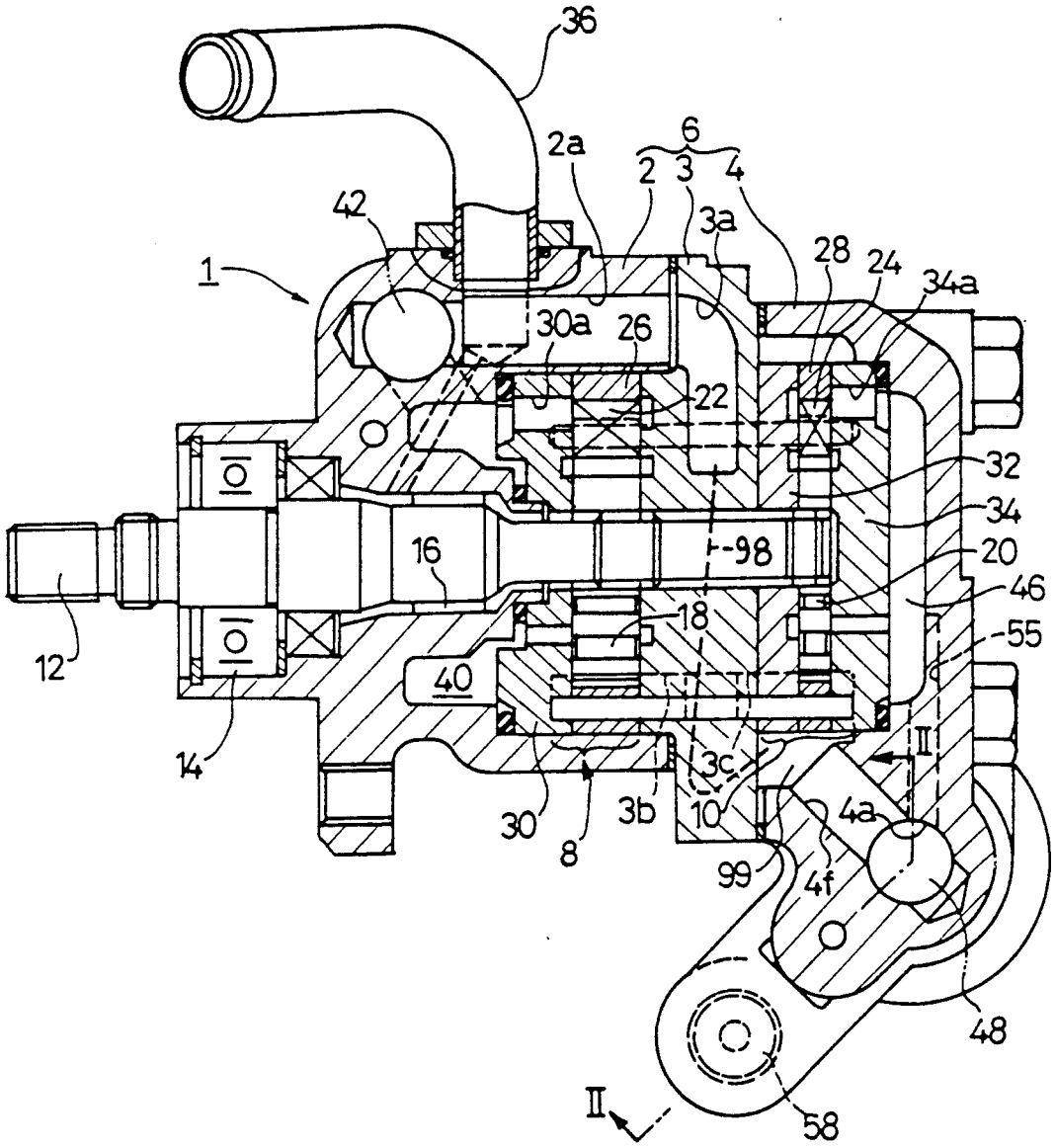
FIG. 1 is a longitudinal section of an oil pump according to one embodiment of the invention.
Figure 2:
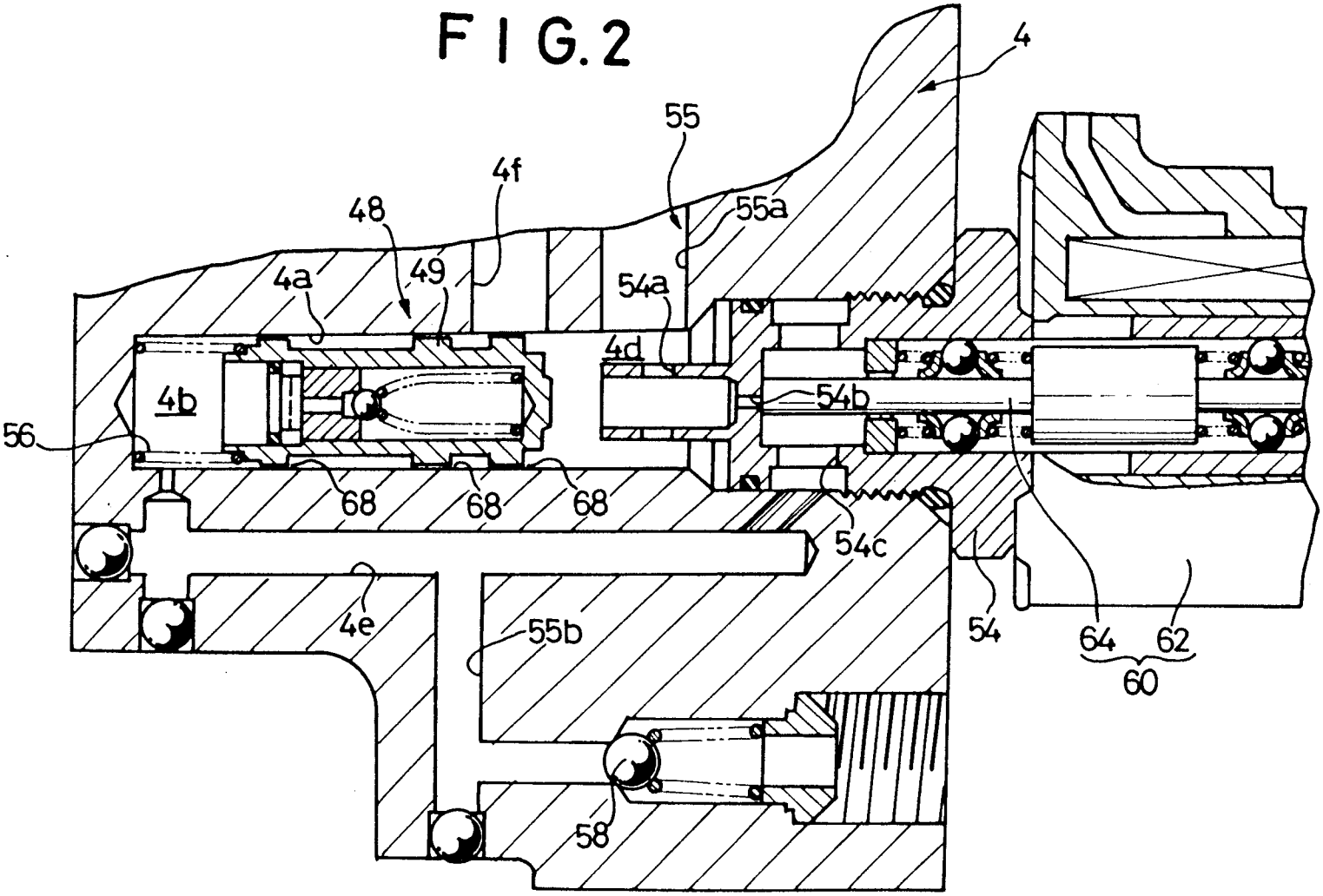
FIG. 2 is a cross section taken along the line II—II shown in FIG. 1.
Figure 3:
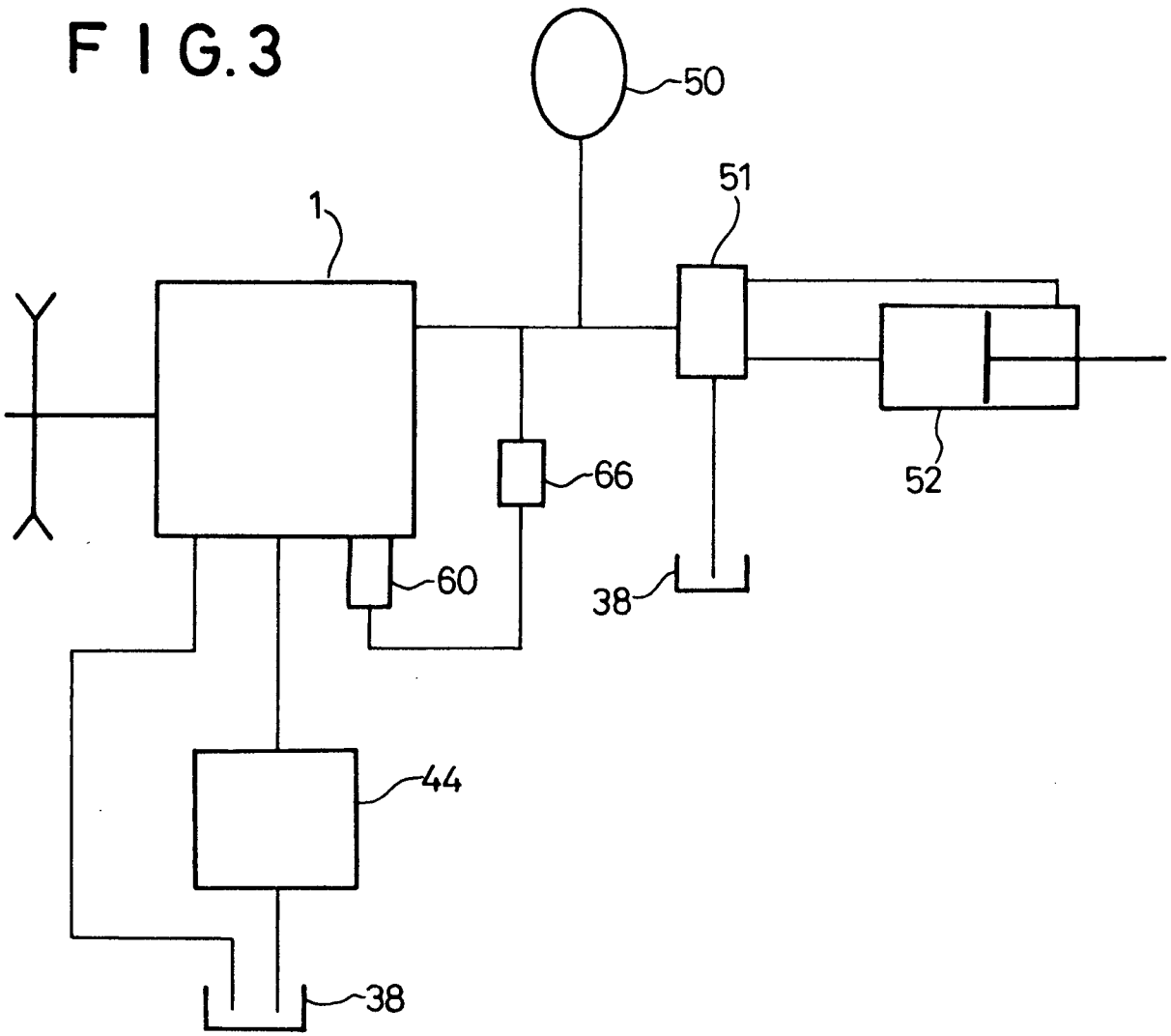
FIG. 3 is a circuit diagram of a hydraulic system of a vehicle which is provided with the oil pump.

Referring to the drawings, an embodiment of the invention will now be described. FIG. 1 is a longitudinal section of a duplex oil pump according to one embodiment of the invention; FIG. 2 is a cross section taken along the line II—II shown in FIG. 1; and FIG. 3 is a circuit diagram of one form of hydraulic system of a vehicle which is provided with the oil pump. Specifically, an oil pump 1 includes a front body 2, a center body 3 and a rear body 4, which are disposed in abutment against each other to define a pump body 6 in which a pair of pump cartridges 8, 10 are contained.

A drive shaft 12 is inserted through an opening of the front body 2 into the pump body 6 and is rotatably carried by a pair of bearings 14, 16. A portion of the drive shaft 12 which is disposed inside the front body 2 has a first rotor 18 splined thereto while an inner end portion thereof which is disposed within the rear body

4 has a second rotor 20 similarly coupled thereto, the both rotors being driven for rotation together by the drive shaft 12. Each of the rotors 18 and 20 is formed with a plurality of radially extending slits which are circumferentially spaced apart at an equal interval, and vanes 22 or 24 are disposed within the slits so as to be radially movable. A pair of cam rings 26 and 28 are disposed in surrounding relationship with the first and the second rotor 18, 20, respectively, and have substantially elliptical cam profiles formed around their internal surfaces.

The first rotor 18 and the cam ring 26 are held between a pressure plate 30 which is disposed inside the front body 2 and the center body 3 to define the first pump cartridge 8 while the second rotor 20 and the cam ring 28 are held between a side plate 32 and a pressure plate 34, both of which are disposed inside the rear body 4, to define the second pump cartridge 10.

In each of the pump cartridges 8 and 10, as the rotor 18 or 20 rotates within the associated cam ring 26 or 28, the vanes 22 or 24 are driven to reciprocate within the slits in sliding contact with the internal surface of the respective cam ring 26 or 28, whereby the volume of each pump chamber defined between a pair of adjacent vanes 22 or 24 increases and decreases, thus producing a pumping action. Specifically, oil is withdrawn from a tank 38 through a suction pipe 36 and suction passages 2*a*, 3*a*, and passes through a first suction port 3*b* and a second suction port 3*c* formed in the center body 3 into the pump chambers in each of the pump cartridges 8, 10. The oil which has been withdrawn into the first pump cartridge 8 is discharged through a discharged port 30*a* formed in the pressure plate 30 into a discharged chamber 40 formed in the front body 2, and thence fed through a first flow control valve 42 to a power steering apparatus 44 while an excess amount of oil is returned to the suction passages 2*a*, 3*a*. On the other hand, the oil which has been withdrawn into the second pump cartridge 10 is discharged through a discharged port 34*a* formed in the pressure plate 34 into a discharge chamber 46 formed in the rear body 4. The discharged oil passes through a second flow control valve 48, to be described later, to be accumulated into an accumulator 50 in order to operate a hydraulic instrument such as power cylinder 52.

An unload valve including the second flow control valve 48 will now be considered. The rear body 4 is formed with a valve opening 4*a* in which a spool 48 is slidably fitted. A union 54 is threadably secured to the opening edge of the valve opening 4*a*, and the sppol 49 is urged toward the union 54 by a spring 56 which is disposed within a chamber 4*b* formed within the valve openings 4*a*, whereby it remains at rest in abutment against the inner end of the union 54 when it is inoperative.

The union 54 is formed with a passage opening 54*a* which extends through a cylindrical inner end thereof, an axially extending orifice 54*b* and a radially extending passage 54*c*. The oil which is discharged from the second pump cartridge 10 into the discharge chamber 46 passes through the upstream side 55*a* of the supply passage 55, a chamber 4*d* within the valve opening 4*a*, the passage opening 54*a*, the orifice 54*b*, the radial passage 54*c* and downstream side 55*b* of the supply passage 55 to open a check valve 58, and thence fed to the accumulator 50. The downstream side 55*b* of the supply passage 55 communicates through a connection passage 4e with a chamber 4b of the valve opening 4a in which the spring 56 is received, thus introducing the oil pressure which prevails at the downstream side of the orifice 54b into the chamber 4b.

When a pressure differential between the oil pressure which is introduced into the chamber 4d upstream of the orifice 54b and the oil pressure introduced into the chamber 4b in which the spring 56 is received exceeds the resilience of the spring 56, the spool 49 is driven to the left, as viewed in the drawing. A return path 4f communicating with the suction passage 3a via a suction passage 99 and a schematically illustrated pasageway 98 (FIG. 1) opens into the valve opening 4a, and is blocked when the spool 49 is inoperative, but is connected to the supply passage 55 to return the discharged oil from the pump cartridge 10 to the suction side when the spool 49 is driven to the left.

A solenoid valve 60 is mounted on the outside of the union 54, and is operatively connected to drive a rod 64 reciprocably in response to the turn-on and —off of a solenoid 62 to open or close the orifice 54b. It should be understood that the solenoid 62 is turned on or off at preselected pressure, by sensing the pressure within the accumulator 50 by means of a pressure switch 66 or any other sensor.

In the apparatus of the present embodiment, a clearance 68 is provided between the outer surface of the spool 49 and the inner surface of the valve opening 4a, permitting the oil in the chamber 4b in which the spring 56 is received to be returned to the return path 4f.

OPERATION

The operation of the oil pump mentioned above will now be described. The oil which is discharged from the first pump cartridge 8 is fed to the power steering apparatus 44 through the first flow control valve 42, and any excess amount of oil is returned to the suction passages 2a, 3a. The oil which is discharged from the second pump cartiridge 10 operates to open the check valve 58 to be fed to the accumulator 50 where it is accumulated.

When the accumulator 50 reaches a preselected pressure, the pressure switch 66 responds thereto by de-energizing the solenoid 62, whereupon the rod 64 is driven to the left to close the orifice 54b.

When a supply of the oil from the upstream side 55a to the downstream side 55b of the supply passage 55 is interrupted, the oil in the chamber 4b in which the spring 56 is received leaks through the clearance 68 between the outer peripheral surface of the spool 49 and the inner peripheral surface of the valve opening 4a to the return path 4f. Thereupon the pressure in the chamber 4b reduces, thus driving the spool 49 to the left to a position where a pressure balance with respect to the chamber 4d located to the right of the spool 49 is achieved or to a position where the oil supplied flows in its entirety to the return path 4f, thus assuming an unloaded condition. At this time, the pressure of the downstream side 55b of the supply passage 55 will be reduced through the connection passage 4e and the chamber 4b, whereby the check valve 58 will be closed (a condition shown in FIG. 2).

The oil which has overflowed into the suction passage 99 merges with the fresh oil which is withdrawn through the suction pipe 36 as well as the oil which has overflowed from the first flow control valve 42, and is then withdrawn into the both pump cartridges 8, 10 through the pair of suction ports 3b, 3c. In this manner, the oil is prevented from reaching extremely high temperatures.

Figure 4:
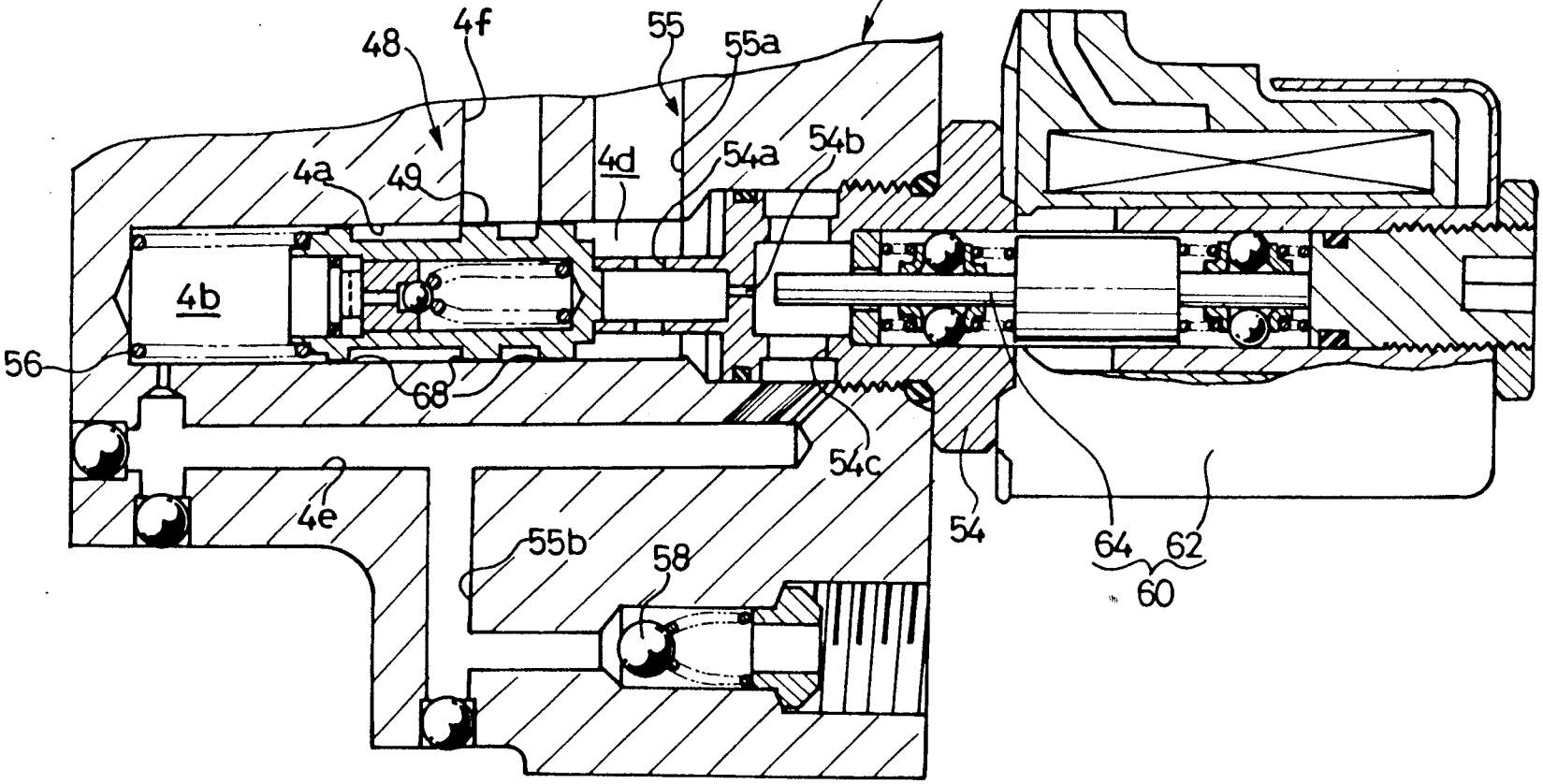
FIG. 4 is a schematic section of parts shown in FIG. 2 during another phase of its operation.

When the accumulator 50 reduces below a given pressure after it has actuated the cylinder 52, the solenoid 60 is magnetized by an electric signal, whereupon the rod 64 retracts to the position shown in FIG. 4 to open the orifice 54b. The spool 49 then moves to a position where the pressure differential across the orifice is balanced out, and the oil which is discharged from the second pump cartridge 10 is fed to the accumulator 50 again by opening the check valve 58.

Thus, in the oil pump of the present embodiment, the spool 49 which is normally utilized to serve as the flow control valve 48 additionally serves an unloading function, thus affording advantages of a compact arrangement and a reduced manufacturing cost. Since the diameter of the orifice 54b can be minimized, the level at which the solenoid 62 is energized may be reduced, thus reducing the power dissipation.

I claim:

1. In an oil pump including a supply passage which supplies an oil discharged from a pump cartridge to an accumulator through a check valve, an openable and closable orifice formed in the supply passage, which orifice is closeable in response to the accumulator reaching a given pressure, means defining a valve opening, which valve opening communicates with the supply passage, a spool slidably fitted in the valve opening, the discharged oil being supplied through said supply passage to a first chamber upstream of the orifice and in communication with a first end of said spool, a second chamber disposed downstream of said orifice and in communication with a second end of said spool opposite said first end, said first chamber communicating with said second chamber via said orifice, the spool being movable in response to a pressure differential between said first end and said second end, said pressure differential being developed as a result of the flow of discharged oil through said orifice, means defining a return path disposed to communicate with the supply passage to facilitate a return of discharged oil to a suction side of the pump cartridge; the improvement wherein the spool is movable between a balanced first position blocking a flow of discharged oil form said first chamber to the return path and a second position facilitating the flow therebetween, and wherein a means defining a clearance is provided between the outer surface of the spool and the inner surface of the valve opening for permitting the discharged oil supplied to said second chamber to be returned to the return path through the clearance and to facilitate a development of said pressure differential and a movement of the spool to the second position in response to a closing of the orifice.

2. The oil pump according to claim 1 in which the oil pump represents a duplex pump including a pair of pump cartridges in a pump body thereof providing the discharged oil, the discharged oil from a first pump cartridge being fed to a power steering apparatus and the discharged oil from a second pump cartridge being fed to the accumulator.

3. The oil pump according to claim 1 in which the orifice is opened and closed by a solenoid valve which is turned on and off in response to a pressure prevailing downstream of the check valve.

* * * * *